US011196166B2

(12) United States Patent
Kakuya et al.

(10) Patent No.: US 11,196,166 B2
(45) Date of Patent: Dec. 7, 2021

(54) ANTENNA DEVICE

(71) Applicant: DENSO CORPORATION, Kariya (JP)

(72) Inventors: Yuuji Kakuya, Nisshin (JP); Yuzi Sugimoto, Nisshin (JP); Hidenori Akita, Kariya (JP)

(73) Assignee: DENSO CORPORATION, Aichi-pref. (JP)

( * ) Notice: Subject to any disclaimer, the term of this patent is extended or adjusted under 35 U.S.C. 154(b) by 0 days.

(21) Appl. No.: 16/840,487

(22) Filed: Apr. 6, 2020

(65) Prior Publication Data

US 2020/0328519 A1 Oct. 15, 2020

(30) Foreign Application Priority Data

Apr. 10, 2019 (JP) ..... JP2019-075084

(51) Int. Cl.
*H01Q 9/04* (2006.01)
*H01Q 1/48* (2006.01)
*H01Q 1/32* (2006.01)

(52) U.S. Cl.
CPC ..... *H01Q 9/0435* (2013.01); *H01Q 1/3275* (2013.01); *H01Q 1/48* (2013.01)

(58) Field of Classification Search
CPC ..... H01Q 9/0435; H01Q 1/48; H01Q 1/3275; H01Q 21/10; H01Q 21/24; H01Q 21/205; H01Q 9/0407; H01Q 9/30; H01Q 1/38; H01Q 1/50
See application file for complete search history.

(56) References Cited

U.S. PATENT DOCUMENTS 10,074,895 B2 * 9/2018 Sugimoto ..... H01Q 13/06
2015/0077305 A1 * 3/2015 Sugimoto ..... H01Q 1/48 343/848
2015/0097738 A1 4/2015 Sugimoto et al.
2016/0285175 A1 * 9/2016 Juan ..... H01Q 1/1214
2018/0198193 A1 7/2018 Wada et al.

FOREIGN PATENT DOCUMENTS

JP 2007-142878 A 6/2007
JP 2015-097377 A 5/2015
JP 2017-022497 A 1/2017
JP 2017-085513 A 5/2017

* cited by examiner

*Primary Examiner* — Daniel D Chang
(74) *Attorney, Agent, or Firm* — Harness, Dickey & Pierce, P.L.C.

(57) ABSTRACT

An antenna device includes a ground plate providing a ground potential, a first feeding part and a second feeding part provided to the ground plate, a vertical antenna element electrically connected to the first feeding part, spaced apart from a first surface of the ground plate, and configured to emit a radio wave having a polarization plane in a direction perpendicular to the ground plate, a horizontal antenna element electrically connected to the second feeding part, arranged in parallel with the ground plate, and configured to emit a radio wave having a polarization plane in a direction parallel to the ground plate, and an antenna base disposed on a second surface of the ground plate, and facing the ground plate and the horizontal antenna element. In the antenna base, at least a portion facing the horizontal antenna element is a dielectric.

6 Claims, 4 Drawing Sheets

ANTENNA DEVICE

CROSS REFERENCE TO RELATED APPLICATION

The present application claims the benefit of priority from Japanese Patent Application No. 2019-075084 filed on Apr. 10, 2019. The entire disclosure of the above application is incorporated herein by reference.

TECHNICAL FIELD

The present disclosure relates to an antenna device.

BACKGROUND

Conventionally, there has been an antenna device that emits two types of radio waves having polarization planes different from each other.

SUMMARY

An antenna device according to an aspect of the present disclosure includes a ground plate, first and second feeding parts provided to the ground plate, a vertical antenna element electrically connected to the first feeding part and spaced apart from a first surface of the ground plate, a horizontal antenna element electrically connected to the second feeding part and arranged in parallel with the ground plate, an antenna base disposed on a second surface of the ground plate, and facing the ground plate and the horizontal antenna element. In the antenna base, at least a portion facing the horizontal antenna element is a dielectric.

BRIEF DESCRIPTION OF DRAWINGS

Objects, features and advantages of the present disclosure will become apparent from the following detailed description made with reference to the accompanying drawings. In the drawings.

DETAILED DESCRIPTION

In a certain antenna system, a ground pattern is formed on a resin substrate, and the resin substrate is vertically arranged so as to be separated upward from a vehicle roof. The antenna system has two feeding points connected to a ground pattern. An antenna element of a monopole antenna extends in a horizontal direction from one feeding point, and another antenna element of another monopole antenna extends in a vertical direction from the other feeding point. The antenna element extending in the horizontal direction mainly transmits and receives horizontally polarized waves, and the antenna element extending in the vertical direction mainly transmits and receives vertically polarized waves.

In the configuration disclosed above, it is necessary to separate the antenna element for transmitting and receiving horizontally polarized waves from a base plate by $\lambda/2$ or more. Therefore, a height of the antenna device from the base plate to an upper end of the antenna device is high.

An antenna device according to an aspect of the present disclosure includes a ground plate, a first feeding part, a vertical antenna element, a second feeding part, a horizontal antenna element, and an antenna base. The ground plate provides a ground potential and has a first surface and a second surface opposite to each other. The first feeding part is provided to the ground plate. The vertical antenna element is electrically connected to the first feeding part, is spaced apart from the first surface of the ground plate; and is configured to emit a radio wave having a polarization plane in a direction perpendicular to the ground plate. The second feeding part is provided to the ground plate. The horizontal antenna element is electrically connected to the second feeding part, is arranged in parallel with the ground plate, and is configured to emit a radio wave having a polarization plane in a direction parallel to the ground plate. The antenna base is disposed on the second surface of the ground plate, and faces the ground plate and the horizontal antenna element. In the antenna base, at least a portion facing the horizontal antenna element is a dielectric.

Since the portion in the antenna base facing the horizontal antenna element is a dielectric, a wavelength shortening effect occurs in radio waves emitted by the horizontal antenna element. Due to the wavelength shortening effect, it is not necessary to separate a metal body from the horizontal antenna element in the direction in which the horizontal antenna element emits radio waves by half or more of the wavelength of the radio waves in a vacuum. Therefore, when the metal body is used as a reference plane, the height from the reference plane to the upper end of the antenna device can be reduced.

First Embodiment

Figure 1:
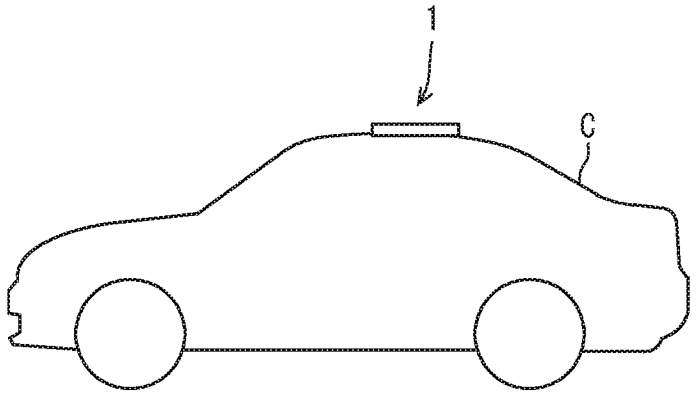
FIG. 1 is a diagram illustrating a state in which an antenna device according to a first embodiment is mounted on a vehicle.

Hereinafter, embodiments will be described with reference to the drawings. In a description of a first embodiment, it is assumed that an antenna device 1 is mounted on a vehicle C as shown in FIG. 1. Specifically, the antenna device 1 is installed on a roof of the vehicle C. However, the antenna device 1 is not always required to be installed on the roof of the vehicle C. An installation position of the antenna device 1 is not particularly limited. The antenna device 1 may be installed on a portion other than the roof of the vehicle C, or may be provided on a moving body different from the vehicle C. Further, the antenna device 1 may be provided on a stationary object.

The antenna device 1 is connected to, for example, a wireless device via a coaxial cable (both are not shown), and signals received by the antenna device 1 are sequentially output to the wireless device. The antenna device 1 converts an electric signal input from the wireless device into a radio wave and emits the radio wave into space. The wireless device uses signals received by the antenna device 1, and also supplies high-frequency power depending on a transmission signal to the antenna device 1. As a power supply line to the antenna device 1, another power supply line such as a feeder line may be used instead of the coaxial cable.

The antenna device 1 is configured to transmit and receive radio waves at a predetermined target frequency. Of course, as another aspect, the antenna device 1 may be used for only one of transmission and reception. Since transmission and reception of radio waves are reversible, a configuration capable of transmitting radio waves at a frequency f1 is also a configuration capable of receiving radio waves at the frequency f1.

The target frequency is, for example, a 28 GHz band which is one of frequency bands assigned to a fifth generation mobile phone communication system. Of course, the target frequency may be appropriately set, and the target frequency is not limited to the 28 GHz band. The antenna device 1 can emit radio waves of the target frequency having a polarization plane parallel to a ground plate 50 or having a polarization plane perpendicular to the ground plate 50. When the ground plate 50 is arranged horizontally, radio waves of the polarization plane parallel to the ground plate 50 are horizontally polarized waves, and radio waves of the polarization plane perpendicular to the ground plate 50 are vertically polarized waves.

Figure 2:
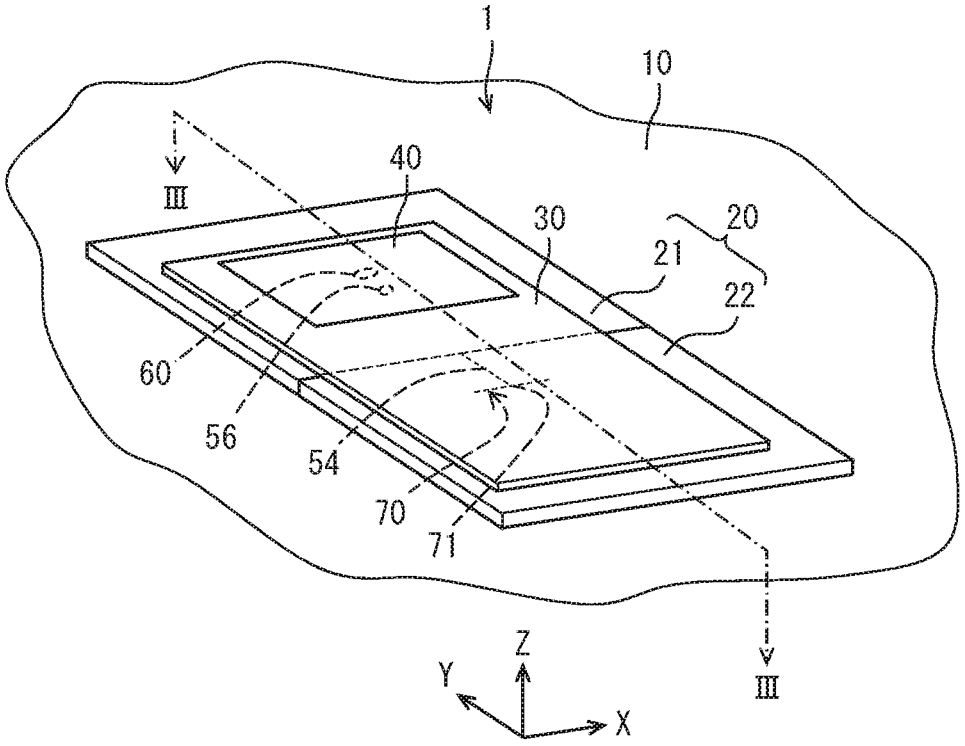
FIG. 2 is a perspective view showing a configuration of the antenna device.

FIG. 2 shows a configuration of the antenna device 1. The antenna device 1 according to the present embodiment uses the roof of the vehicle C as a base plate 10. Although not shown in FIG. 2, the antenna device 1 is appropriately provided with a cover that entirely covers the antenna device 1.

As shown in FIG. 2, the antenna device 1 has a flat plate shape as a whole. The antenna device 1 has a rectangular shape in plan view. In FIG. 2, in addition to the base plate 10, an antenna base 20, a resin substrate 30, and a counter conductor plate 40 can be visually recognized as elements included in the antenna device 1. The plan view means that the antenna device 1 is viewed in a direction from the counter conductor plate 40 toward the base plate 10.

The base plate 10 can be prepared separately from the roof of the vehicle C. When the base plate 10 is provided separately from the roof of the vehicle C, the base plate 10 is set to be larger than the antenna base 20.

The antenna base 20 is a member provided for a purpose of electrically connecting the ground plate 50 and the base plate 10 to stabilize a ground potential and for a purpose of providing a space between a horizontal antenna element 70 and the base plate 10. Hereinafter, in the present disclosure, the term "connect" means "electrically connect".

For these two purposes, the antenna base 20 includes a metal base portion 21 made of metal as a conductive portion and a resin base portion 22 made of resin as a dielectric portion. The metal base portion 21 and the resin base portion 22 have the same length in a width direction. Therefore, the antenna base 20 has a thin rectangular flat plate shape as a whole, in other words, a thin rectangular parallelepiped shape.

Figure 3:
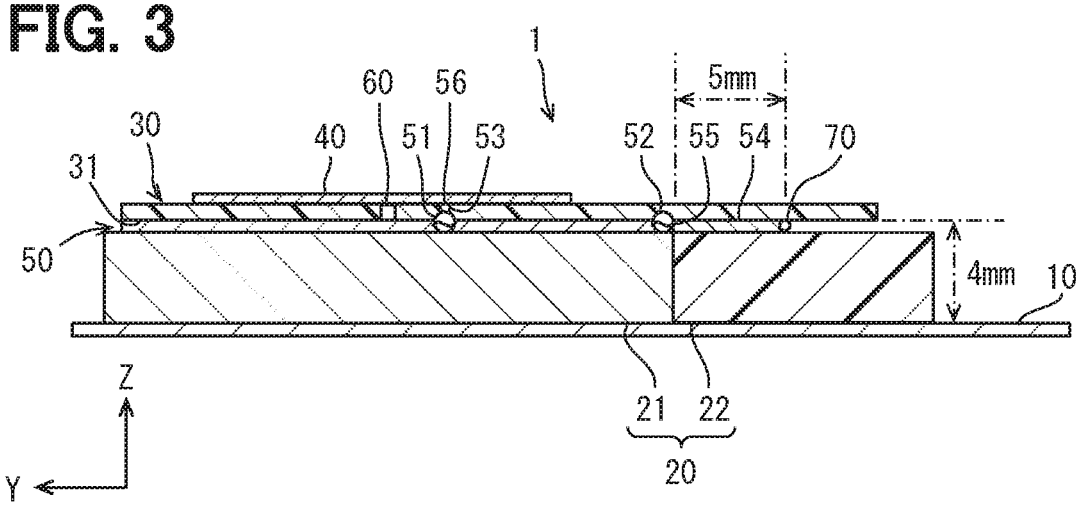
FIG. 3 is a cross-sectional view of the antenna device taken along line of FIG. 2.

In the drawings, the X axis indicates the width direction of the antenna base 20. The Y axis indicates a longitudinal direction of the antenna base 20. The Z axis indicates a vertical direction of the antenna base 20. A three-dimensional coordinate system including the X axis; the Y axis, and the Z axis is a concept for describing the configuration of the antenna device 1. The following description also refers to FIG. 3. FIG. 3 is a cross-sectional view of the antenna device 1 taken along line III-III of FIG. 2. A cross section taken along the line is a section that bisects the antenna device 1 in the width direction.

The metal base portion 21 has a first surface being in contact with the ground plate 50 and a second surface being in contact with the base plate 10. Therefore, the ground plate 50 and the base plate 10 have the same potential. The resin base portion 22 has a first surface facing the resin substrate 30 and a second surface being in contact with the base plate 10. The resin base portion 22 is a member for producing a wavelength shortening effect on radio waves transmitted and received by the horizontal antenna element 70. The horizontal antenna element 70 has a relative permittivity of, for example, 42.

The resin substrate 30 also has a thin plate shape. The resin substrate 30 is a plate-shaped member for arranging the ground plate 50 and the counter conductor plate 40 to face each other with a predetermined interval. As a material of the resin substrate 30, a dielectric having a predetermined relative permittivity, such as a glass epoxy resin, can be used. The resin substrate 30 has a relative dielectric permittivity of 3.2, for example. The resin substrate 30 has a rectangular shape in plan view. The resin substrate 30 is smaller than the antenna base 20 in plan view.

In the present embodiment, the resin substrate 30 has a thickness of 0.1 mm, for example. The thickness of the resin substrate 30 corresponds to a distance between the ground plate 50 and the counter conductor plate 40. By adjusting the thickness of the resin substrate 30, the distance between the counter conductor plate 40 and the ground plate 50 can be adjusted. The specific value of the thickness of the resin substrate 30 may be appropriately determined by a simulation or a test.

Note that the resin substrate 30 only has to fulfill the above-described role, and the shape of the resin substrate 30 can be changed as appropriate. A configuration for arranging the counter conductor plate 40 to face the ground plate 50 may be a plurality of columns. In the present embodiment, a configuration in which a space between the ground plate 50 and the counter conductor plate 40 is filled with a resin as the resin substrate 30 is adopted, but a configuration between the ground plate 50 and the counter conductor plate 40 is not limited. The space between the ground plate 50 and the counter conductor plate 40 may be hollow or vacuum. The resin substrate 30 may have a honeycomb structure, for example. In addition, the structures exemplified above may be combined. When the antenna device 1 is realized using a printed wiring board, a plurality of conductor layers included in the printed wiring board may be used as the ground plate 50 and the counter conductor plate 40, and a resin layer separating the conductor layers may be used as the resin substrate 30.

The thickness of the resin substrate 30 also functions as a parameter for adjusting a length of a short-circuit portion 60 (in other words, an inductance provided by the short-circuit portion 60), as described later. The thickness of the resin substrate 30 also functions as a parameter for adjusting a capacitance formed by the ground plate 50 and the counter conductor plate 40 facing each other.

The counter conductor plate 40 is a conductive member having a plate shape and made of a conductor such as copper. The counter conductor plate 40 is an example of a vertical antenna element. The plate shape here includes a thin film shape such as a copper foil. The counter conductor plate 40 has a size smaller than the ground plate 50 in plan view, and faces the ground plate 50 through the resin substrate 30 in a thickness direction. On the other hand, the counter conductor plate 40 does not face the resin base portion 22. The counter conductor plate 40 is parallel to the ground plate 50. The term "parallel" here is not limited to perfect parallel. The counter conductor plate 40 may be inclined from several degrees to about ten degrees with respect to the ground plate 50. That is, the term "parallel" includes a substantially parallel state.

The planar shape of the counter conductor plate 40 shown in FIG. 2 is a square. As shown in FIG. 2, the counter conductor plate 40 is disposed on the resin substrate 30 in such a manner that one set of opposite sides is parallel to the X axis and another set of opposite sides is parallel to the Y axis.

However, the planar shape of the counter conductor plate 40 may be another shape. The planar shape of the counter conductor plate 40 may be a circle, a regular octagon, a regular hexagon, or the like. Further, the counter conductor plate 40 may have a rectangular shape or an oblong shape. It is preferable that the counter conductor plate 40 has a line-symmetrical shape (hereinafter, a two-way line-symmetric shape) with each of two straight lines orthogonal to each other as axes of symmetry. The two-way line-symmetric shape refers to a figure that is line-symmetric with a first straight line as an axis of symmetry, and that is also line-symmetric with respect to a second straight line that is orthogonal to the first straight line. For example, an ellipse, a rectangle, a circle, a square, a regular hexagon, a regular octagon, a diamond, and the like correspond to the two-way line symmetric shape. It is more preferable that the counter conductor plate 40 is a point-symmetrical figure such as a circle, a square, a rectangle, and a parallelogram.

Further, a slit may be provided to the counter conductor plate 40, or a corner of the counter conductor plate 40 may be rounded. For example, a notch as a degenerate separation element may be provided at a pair of diagonal portions. An edge portion of the counter conductor plate 40 may be partially or entirely formed in a meander shape. Irregularities provided at the edge portion of the counter conductor plate 40 that do not affect the operation can be ignored.

As shown in FIG. 3, the antenna device 1 includes the ground plate 50 in addition to the antenna base 20, the resin substrate 30, and the counter conductor plate 40. The ground plate 50 is a conductive member having a plate shape and made of conductor such as copper. The plate shape here includes a foil shape and a thin film shape. The ground plate 50 is disposed on a ground arrangement surface 31 that is one surface in the thickness direction of the resin substrate 30. The ground plate 50 has a first surface and a second surface opposite to each other. The counter conductor plate 40 is spaced apart from the first surface of the ground plate 50, and the antenna base 20 is disposed on the second surface of the ground plate 50.

The ground arrangement surface 31 is a surface of the resin substrate 30 close to the base plate 10. The ground plate 50 has a shape that matches the portion of the resin substrate 30 facing the metal base portion 21 in plan view. Note that the ground plate 50 is not shown in FIG. 2. The metal base portion 21 has a rectangular shape in plan view. Thus, the ground plate 50 also has a rectangular shape in plan view.

The size of the ground plate 50 can be appropriately changed. The length of one side of the ground plate 50 may be set to a value electrically smaller than one wavelength (for example, ⅓ of a target wavelength). Conversely, the size of the ground plate 50 can be larger than a circle having a diameter of one wavelength.

The shape of the ground plate 50 as viewed from above (hereinafter a planar shape) can be changed as appropriate. Here, as an example, the planar shape of the ground plate 50 is rectangular, but in another aspect, the planar shape of the ground plate 50 may be a square shape or another polygonal shape. For example, the ground plate 50 may have a square shape in which one side is electrically set to a value corresponding to one wavelength. Further, the shape of the ground plate 50 may be a two-way line-symmetric shape. It is preferable that the metal base portion 21 has a size equal to or larger than the size of the ground plate 50.

The ground plate 50 is provided with a first feeding part 51 and a second feeding part 52. The first feeding part 51 is a part where a power supply line (not shown) is connected to an element connection line 53. The second feeding part 52 is a part where a power supply line (not shown) is connected to an element connection line 54. Coaxial cables can be used as the power supply lines.

At the first feeding part 51, an external conductor of the coaxial cable and the ground plate 50 are connected. At the second feeding part 52, an external conductor of the coaxial cable and the ground plate 50 are connected. Accordingly, the ground plate 50 provides a ground potential in the antenna device 1.

The first feeding part 51 may be provided at a position where a characteristic impedance of the coaxial cable can be matched with an impedance at the target frequency at a portion closer to the counter conductor plate 40 than the first feeding part 51. The target frequency here is a frequency at which the counter conductor plate 40 is operated as an antenna element. Describing the position of the first feeding part 51 from another viewpoint, the first feeding part 51 may be provided at a position where a return loss is at a predetermined allowable level.

In the present embodiment, the second feeding part 52 is provided on an element facing side 55 of the ground plate 50. The element facing side 55 is a side of the ground plate 50 that faces the horizontal antenna element 70. A length of the element facing side 55 is longer than a length of the horizontal antenna element 70.

One end of the element connection line 53 is connected to the first feeding part 51, and the other end of the element connection line 53 is connected to the counter conductor plate 40. The end of the element connection line 53 connected to the counter conductor plate 40 is an element feeding point 56 for supplying power to the counter conductor plate 40 as the antenna element. The element connection line 53 is formed of a conductor pin, a via, and the like. Further, an internal conductor of the coaxial cable may be used as the element connection line 53.

As a power supply method to the counter conductor plate 40, various methods such as a direct connection power supply method and an electromagnetic coupling method can be adopted. The direct connection power supply method refers to a method in which a microstrip line, a conductor pin, a via, or the like connected to the internal conductor of the coaxial cable (that is, for power supply) is directly connected to the counter conductor plate 40. The electromagnetic coupling method refers to a power supply method using electromagnetic coupling between a microstrip line or the like for power supply and the counter conductor plate 40.

One end of the element connection line 54 is connected to the second feeding part 52, and the other end of the element connection line 54 is connected to the horizontal antenna element 70. The element connection line 54 can be formed of a microstrip line. Further, an internal conductor of the coaxial cable may be used as the element connection line 54.

The short-circuit portion 60 is a conductive member that electrically connects the ground plate 50 and the counter conductor plate 40. The short-circuit portion 60 may be realized using a conductive pin (hereinafter, short pin). An inductance of the short-circuit portion 60 can be adjusted by adjusting a diameter and a length of the short pin serving as the short-circuit portion 60.

The short-circuit portion 60 may be a linear member having one end connected to the ground plate 50 and the other end connected to the counter conductor plate 40. When the antenna device 1 is realized using a printed wiring board as a base material, a via provided on the printed wiring board can be used as the short-circuit portion 60.

The short-circuit portion 60 is provided, for example, so as to be located at a center of the counter conductor plate 40. Note that a position where the short-circuit portion 60 is formed does not need to exactly coincide with the center of the counter conductor plate 40. The short-circuit portion 60 may be formed in a center region of the counter conductor plate 40. The short-circuit portion 60 is for generating a voltage standing wave having a node at a portion of the short-circuit portion 60. When the voltage standing wave is generated, the antenna device 1 transmits and receives radio waves having a polarization plane perpendicular to the counter conductor plate 40 and the ground plate 50. The short-circuit portion 60 may be arranged at a position deviated from the center of the counter conductor plate 40 as long as transmission and reception characteristics of the radio waves are allowed. For example, the center region of the counter conductor plate 40 may be a region inside a line connecting points that internally divide the center to the edge of the counter conductor plate 40 at 1:5. In another example, the center region may be a region where a concentric figure obtained by reducing the size of the counter conductor plate 40 by a factor of about ⅙ is overlapped. The horizontal antenna element 70 is provided on a surface of the resin substrate 30 facing the resin base portion 22. As shown in FIG. 3, a distance between the surface of the resin substrate 30 facing the resin base portion 22 and the base plate 10 is 4 mm. The thickness of the antenna base 20 is adjusted so as to provide the above distance.

When the target frequency is 28 GHz, the wavelength is about 10 mm in a vacuum. In order to prevent the gain of radio waves emitted by the horizontal antenna element 70 from being reduced by the influence of the base plate 10, the horizontal antenna element 70 needs to be separated from the base plate 10 by a half wavelength or more. The half wavelength is 5 mm in a vacuum. However, in the antenna device 1, the resin base portion 22 is interposed between the surface of the resin substrate 30 facing the resin base portion 22 and the base plate 10. The presence of the resin base portion 22 causes a wavelength shortening effect. Therefore, the distance between the surface of the resin substrate 30 facing the resin base portion 22 and the base plate 10 can be 4 mm, which is shorter than the half wavelength of 5 mm.

The horizontal antenna element 70 has a linear shape. An electrical length of the horizontal antenna element 70 is half of the wavelength $\lambda$ of radio waves of the target frequency (hereinafter, target wavelength). Note that the electrical length of the horizontal antenna element 70 does not need to be exactly $\lambda/2$. The electric length of the horizontal antenna element 70 may be longer or shorter than $\lambda/2$ as long as radio waves of the target frequency are transmitted from the horizontal antenna element 70 with required power.

An arrangement direction of the horizontal antenna element 70 is parallel to the element facing side 55 which has a linear shape. A distance between the horizontal antenna element 70 and the element facing side 55 is half of the target wavelength $\lambda$. When the target frequency is 28 GHz, the wavelength is about 10 mm. Therefore, when the target frequency is 28 GHz, the distance between the element facing side 55 and the horizontal antenna element 70 is about 5 mm as shown in FIG. 3.

The horizontal antenna element 70 is also parallel to the ground arrangement surface 31. That is, the direction in which the horizontal antenna element 70 extends from one end to the other end is a direction along the ground arrangement surface 31 and the ground plate 50 parallel to the ground arrangement surface 31.

The horizontal antenna element 70 is connected to the second feeding part 52 through the element connection line 54. The element connection line 54 is connected to a longitudinal center of the horizontal antenna element 70. This point is referred to as an element feeding point 71.

However, the position of the element feeding point 71 is not limited to the longitudinal center of the horizontal antenna element 70. The element feeding point 71 can be at various longitudinal positions of the horizontal antenna element 70. For example, one end of the horizontal antenna element 70 may be the element feeding point 71.

The horizontal antenna element 70 does not need to be linear as long as the horizontal antenna element 70 has a portion that is parallel to the element facing side 55. For example, an L-shaped linear antenna element may be employed as the horizontal antenna element 70.

The operation of the antenna device 1 configured as described above will be described. In the description of the operation of the antenna device 1, it is assumed that the base plate 10 and the ground plate 50 are parallel to the ground, that is, horizontal. In the present case, the antenna device 1 transmits and receives horizontally polarized waves and vertically polarized waves.

First, the operation of transmitting vertically polarized waves by the antenna device 1 will be described. The counter conductor plate 40 is short-circuited to the ground plate 50 by the short-circuit portion 60 provided in the center region of the counter conductor plate 40, and the area of the counter conductor plate 40 is equal to an area for forming a capacitance that resonates in parallel with the inductance of the short-circuit portion 60 at the target frequency.

For this reason, a parallel resonance (so-called an LC parallel resonance) occurs due to an energy exchange between the inductance and the capacitance, and a vertical electric field is generated between the ground plate 50 and the counter conductor plate 40. This vertical electric field propagates from the short-circuit portion 60 toward the edge of the counter conductor plate 40, and at the edge of the counter conductor plate 40, the vertical electric field becomes a linearly polarized wave (ground plate vertically polarized wave) having a polarization plane perpendicular to the ground plate 50 and propagates in space. In the present disclosure, the ground plate vertically polarized wave refers to a radio wave in which an oscillation direction of the electric field is perpendicular to the ground plate 50 and the counter conductor plate 40. When the antenna device 1 is used in a posture parallel to the horizontal plane, the ground plate vertically polarized wave refers to a polarized wave in which the oscillation direction of the electric field is perpendicular to the ground (so-called a vertically polarized wave).

Figure 4:
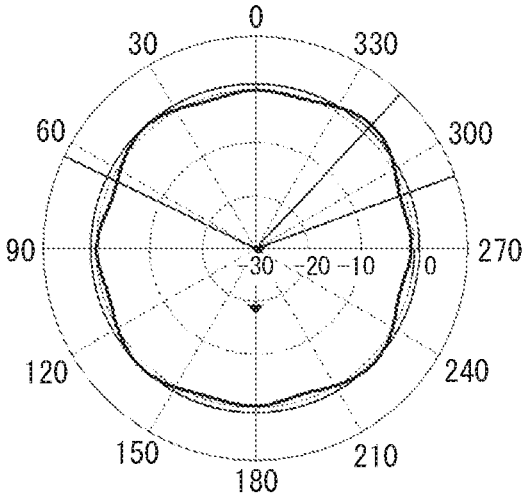
FIG. 4 is a diagram illustrating vertical polarization characteristics of the antenna device.

The propagation direction of the vertical electric field is symmetric about the short-circuit portion 60. Therefore, as shown in FIG. 4, the antenna device 1 has the same gain in all directions in the horizontal plane. In other words, at the target frequency, the antenna device 1 has a directivity in all directions from the center region toward the edge of the counter conductor plate 40 (that is, an antenna horizontal direction). FIG. 4 is a result obtained by a simulation, and the base plate 10 was set to 100 mm×100 mm as a finite size.

When the ground plate 50 is disposed so as to be horizontal, the antenna device 1 functions as an antenna having a main beam in the horizontal direction. In the present disclosure, the antenna horizontal plane refers to a plane parallel to the ground plate 50 and the counter conductor plate 40. Furthermore, the antenna horizontal direction refers to a direction from the center region toward the edge of the counter conductor plate 40. According to another viewpoint, the antenna horizontal direction refers to a direction perpendicular to a perpendicular line to the ground plate 50 passing through the center of the counter conductor plate 40. The antenna horizontal direction corresponds to a lateral direction of the antenna device 1.

Since the short-circuit portion 60 is disposed at the center of the counter conductor plate 40, a current that flows through the counter conductor plate 40 is symmetric about the short-circuit portion 60. Therefore, a radio wave in the antenna height direction generated by a current that flows through the counter conductor plate 40 in a certain direction from the center of the counter conductor plate 40 is canceled by a radio wave generated by a current that flows in the opposite direction. That is, the current excited by the counter conductor plate 40 does not contribute to the emission of radio waves. Therefore, the antenna device 1 does not emit a vertically polarized radio wave in the upward direction. Hereinafter, for convenience, a mode in which the antenna device 1 operates by the LC parallel resonance of the capacitance formed between the ground plate 50 and the counter conductor plate 40 and the inductance of the short-circuit portion 60 is referred to as an LC resonance mode. The LC resonance mode corresponds to an operation mode using a voltage oscillation of the counter conductor plate 40 with respect to the ground plate 50. The LC resonance mode corresponds to a zeroth-order resonance mode. The antenna device 1 in the LC resonance mode corresponds to a voltage antenna.

Next, the operation of transmitting horizontally polarized waves by the antenna device 1 will be described. Power is supplied from the second feeding part 52 to the horizontal antenna element 70 through the element connection line 54. When the power is supplied to the horizontal antenna element 70, the horizontal antenna element 70 emits radio waves of the target frequency around an axis centered on the horizontal antenna element 70 having the linear shape. Since the horizontal antenna element 70 is disposed parallel to the ground plate 50, the polarization plane of the radio waves emitted by the horizontal antenna element 70 is parallel to the ground plate 50 and the base plate 10. Therefore, when the ground plate 50 is disposed horizontally, the radio waves emitted from the horizontal antenna element 70 are horizontally polarized waves.

Figure 5:
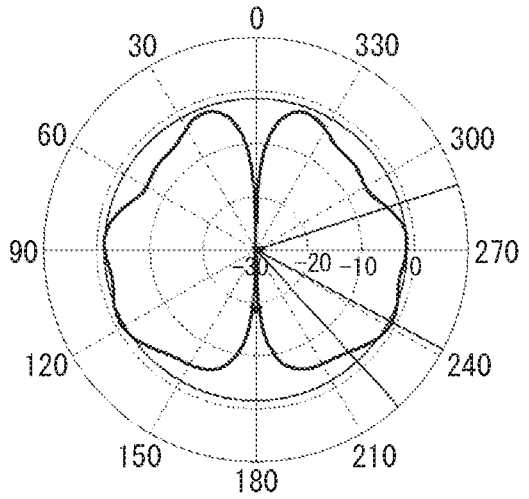
FIG. 5 is a diagram illustrating horizontal polarization characteristics of the antenna device.

The distance between the horizontal antenna element 70 and the element facing side 55 is half of the target wavelength λ. Thus, the element facing side 55 functions as a reflector. Therefore, the radio waves radiated from the horizontal antenna element 70 are strengthened, and the gain is increased. As a result, as shown in FIG. 5, the gain of the horizontal polarized wave is also close to the gain of the vertically polarized waves shown in FIG. 5.

The operation of the antenna device 1 when transmitting radio waves and the operation of the antenna device 1 when receiving radio waves are mutually reversible. That is, the antenna device 1 can receive the ground plate vertically polarized waves arriving from the antenna horizontal direction and the polarized waves arriving from the antenna horizontal direction and parallel to the base plate 10.

As described above, in the antenna device 1 according to the present embodiment, the portion of the antenna base 20 facing the horizontal antenna element 70 is the resin base portion 22 that is a dielectric. As a result, since the wavelength shortening effect is generated in the radio waves emitted by the horizontal antenna element 70, the distance from the horizontal antenna element 70 to the base plate 10 does not need to be equal to or longer than half of the target wavelength λ. Therefore, the height from the base plate 10 to an upper end of the antenna device 1 can be reduced.

Further, the antenna base 20 is not entirely made of resin. The antenna base 20 includes the metal base portion 21 that is in contact with the ground plate 50. As a result, a member having a ground potential is increased in size, and the ground potential is stabilized.

Further, the metal base portion 21 is in contact with the base plate 10. Accordingly, the ground potential is further stabilized. The base plate 10 faces the horizontal antenna element 70, and the distance between the base plate 10 and the horizontal antenna element 70 is shorter than half of the target wavelength λ. However, since the resin base portion 22 is interposed between the horizontal antenna element 70 and the base plate 10, the above-described wavelength shortening effect occurs. Thus, the distance between the base plate 10 and the horizontal antenna element 70 can be shorter than half of the target wavelength λ, and the decrease in the gain of the horizontal polarization can be suppressed.

In the antenna device 1, the counter conductor plate 40 and the ground plate 50 are connected by the short-circuit portion 60, and are subjected to the LC parallel resonance to generate the vertically polarized waves. Accordingly, a configuration for generating the vertically polarized waves can be reduced in thickness, and the device height of the entire antenna device 1 can be reduced.

In the antenna device 1, the element facing side 55 and the horizontal antenna element 70 are arranged so that the element facing side 55 functions as the reflector of the horizontal antenna element 70. That is, the antenna device 1 enhances the gain of horizontal polarized waves by utilizing the ground plate 50 that is configured to generate vertically polarized waves.

Second Embodiment

Next, a second embodiment will be described. In the description of the second and subsequent embodiments, elements having the same reference numerals as those used so far are identical to the elements having the same reference numerals in the previous embodiment(s), unless otherwise specified. When only a part of the configuration is described, the embodiment described above can be applied to other parts of the configuration.

Figure 6:
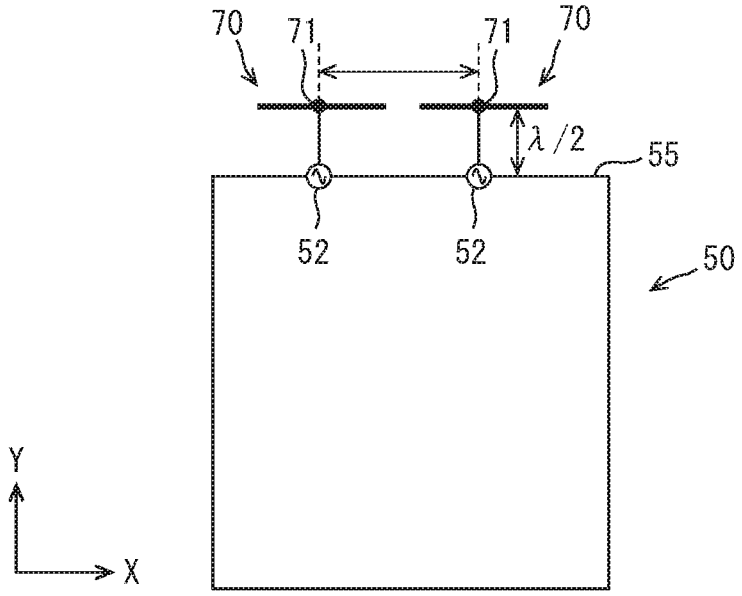
FIG. 6 is a diagram illustrating a positional relationship between a ground plate and a plurality of horizontal antenna elements in a second embodiment.

FIG. 6 shows a part of a configuration of the antenna device according to the second embodiment. FIG. 6 is a diagram showing a positional relationship between the ground plate 50 and a plurality of horizontal antenna elements 70. As shown in FIG. 6, the antenna device 1 according to the second embodiment includes two horizontal antenna elements 70 facing the same element facing side 55. A distance between element feeding points 71 of the two horizontal antenna elements 70 is λ/4 or more.

In the antenna device 1 according to the first embodiment, the second feeding part 52 is provided at the center of the element facing side 55. On the other hand, in the second embodiment, the second feeding parts 52 are moved toward both ends of the element facing side 55 because two second feeding parts 52 are provided on one element facing side 55.

With the movement of the positions of the second feeding parts 52, the positions of the two horizontal antenna elements 70 are also moved in parallel from the position of the horizontal antenna element 70 in the first embodiment along the element facing side 55. Otherwise, the size and the posture of the horizontal antenna elements 70 are the same as in the first embodiment.

Figure 7:
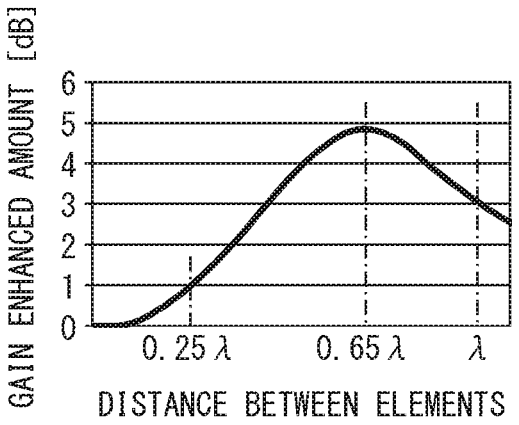
FIG. 7 is a diagram illustrating a relationship between a distance between elements and a gain enhanced amount.

The distance between the two element feeding points 71 is λ/4 or more. In this case, the gain is enhanced as compared with a configuration including only one horizontal antenna element 70. FIG. 7 shows a relationship between the distance between elements and the gain enhanced amount. The distance between elements is the distance from the element feeding point 71 of one horizontal antenna element 70 to the element feeding point 71 of the other horizontal antenna element 70.

As shown in FIG. 7, the gain is enhanced by 1 dB or more at 0.25λ or more, that is, at λ/4 or more. Therefore, the distance between elements is preferably λ/4 or more. As shown in FIG. 7, when the distance between elements is 0.65λ or more, the gain enhanced amount decreases with increase in the distance between elements. Further, a side lobe may become large when the distance between elements is λ or more. However, even if the distance between elements increases, the gain is enhanced as compared with the case where the number of the horizontal antenna elements 70 is one.

Third Embodiment

Figure 8:
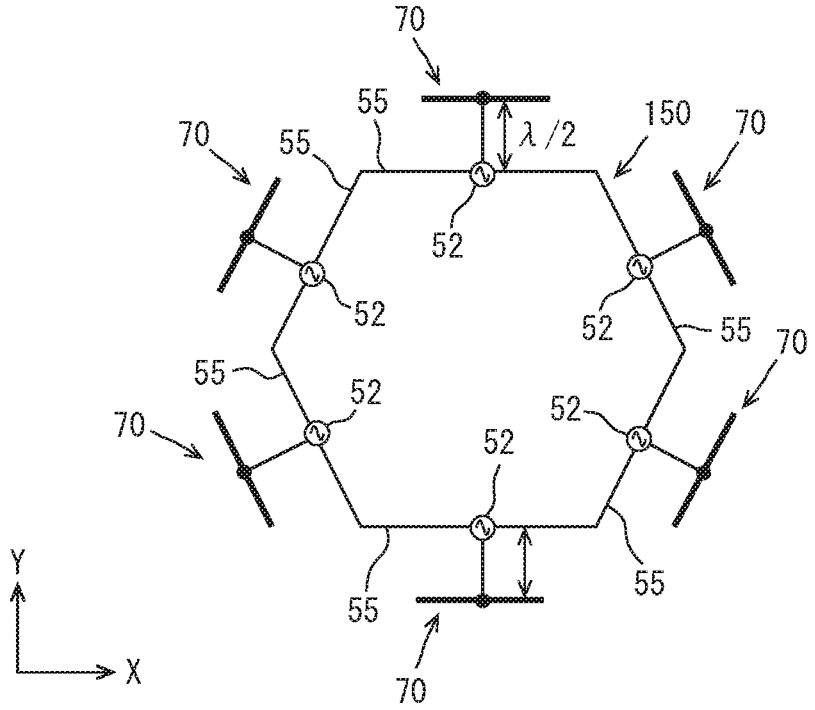
FIG. 8 is a diagram illustrating a positional relationship between a ground plate and a plurality of horizontal antenna elements in a third embodiment.

FIG. 8 shows a part of a configuration of an antenna device according to a third embodiment. A ground plate 150 shown in FIG. 8 is a regular hexagon in plan view. In the third embodiment, each side of the ground plate 150 is the element facing side 55. Six horizontal antenna elements 70 are provided, and each of the horizontal antenna elements 70 is disposed so as to face a different one of the element facing sides 55.

In the antenna device according to the third embodiment, the ground plate 150 includes the plurality of element facing sides 55 to which the different horizontal antenna elements 70 face each other. In addition, the plurality of horizontal antenna elements 70 is respectively arranged in parallel to the plurality of element facing sides 55. Therefore, the antenna element of the third embodiment can have directivity of horizontal polarized waves in a plurality of directions. The horizontal antenna elements 70 may be supplied with power at the same time, or the number of horizontal antenna elements 70 to be supplied at each time may be limited to a part of the horizontal antenna elements 70. For example, power may be supplied to one of the horizontal antenna elements 70 at each time.

Although the embodiments of the present disclosure have been described above, the present disclosure is not limited to the above embodiments, and various modified examples described below are also included in the technical scope of the present disclosure. Furthermore, various modifications other than the following can be made without departing from the gist.

(First Modification)

In the above-described embodiments, the counter conductor plate 40 is shown as the vertical antenna element. However, a linear antenna element provided perpendicular to the ground plate 50 may be used as the vertical antenna element. This linear antenna element may have a coil portion in part, or may have a bent shape.

(Second Modification)

In the above-described embodiments, the metal base portion 21 made of metal is shown as the conductor portion. However, a conductor other than metal can be used as the material of the conductor portion. Also, in the above-described embodiments, the resin base portion 22 made of resin is shown as the dielectric portion. However, a dielectric other than resin can be used as the material of the dielectric portion.

(Third Modification)

In the third embodiment, the shape of the ground plate 150 is a regular hexagon. However, the shape of the ground plate 150 may be another polygon, for example, a square or an equilateral triangle.

(Fourth Modification)

In the second embodiment, two horizontal antenna elements 70 are arranged to face one element facing side 55. However, three or more horizontal antenna elements 70 may be arranged to face one element facing side 55. In such a case, a distance between the element feeding points 70 of adjacent two of the horizontal antenna elements 70 is preferably set to be λ/4 or more.

What is claimed is:

1. An antenna device comprising:

a ground plate providing a ground potential and having a first surface and a second surface opposite to each other;

a first feeding part provided to the ground plate;

a vertical antenna element electrically connected to the first feeding part, spaced apart from the first surface of the ground plate, and configured to emit a radio wave having a polarization plane in a direction perpendicular to the ground plate;

a second feeding part provided to the ground plate;

a horizontal antenna element electrically connected to the second feeding part, arranged in parallel with the ground plate, and configured to emit a radio wave having a polarization plane in a direction parallel to the ground plate; and an antenna base disposed on the second surface of the ground plate, and facing the ground plate and the horizontal antenna element, wherein the antenna base includes a conductive portion being in contact with the ground plate and a dielectric portion facing the horizontal antenna element.

2. The antenna device according to claim 1, further comprising a base plate on which the antenna base is disposed, wherein a distance between the horizontal antenna element and the base plate is shorter than half of a wavelength of the radio wave emitted by the horizontal antenna element.

3. The antenna device according to claim 1, further comprising a short-circuit portion, wherein the vertical antenna element is a counter conductor plate that is a conductive member having a plate shape, the counter conductor plate is spaced apart from the ground plate and is electrically connected to the first feeding part, and the short-circuit portion is disposed in a center region of the counter conductor plate and electrically connects the counter conductor plate and the ground plate.

4. The antenna device according to claim 1, wherein the horizontal antenna element is a linear antenna element, the ground plate has an element facing side that is linear and faces the horizontal antenna element, the horizontal antenna element is arranged in parallel with the element facing side, and a distance between the horizontal antenna element and the element facing side is half of a wavelength of the radio wave emitted by the horizontal antenna element.

5. The antenna device according to claim 4, wherein the horizontal antenna element is one of a plurality of horizontal antenna elements each facing the element facing side, each of the plurality of horizontal antenna elements has an element feeding point electrically connected to the second feeding part, and a distance between the element feeding points of adjacent two of the plurality of horizontal antenna elements is ¼ or more of the wavelength of the radio wave emitted by each of the plurality of horizontal antenna elements.

6. The antenna device according to claim 4, wherein the horizontal antenna element is one of a plurality of horizontal antenna elements, the element facing side is one of a plurality of element facing sides of the ground plate, and each of the plurality of horizontal antenna elements faces a different one of the plurality of element facing sides.

* * * * *